US009093195B1

(12) United States Patent
Kummer et al.

(10) Patent No.: US 9,093,195 B1
(45) Date of Patent: Jul. 28, 2015

(54) RUGGED CABLE

(75) Inventors: Randy D. Kummer, Villa Rica, GA (US); John R. Carlson, Newnan, GA (US); Mark Dixon, Carrollton, GA (US)

(73) Assignee: Southwire Company, LLC, Carrollton, GA (US)

( * ) Notice: Subject to any disclaimer, the term of this patent is extended or adjusted under 35 U.S.C. 154(b) by 628 days.

(21) Appl. No.: 12/713,440

(22) Filed: Feb. 26, 2010

(51) Int. Cl.
*H01B 7/18* (2006.01)

(52) U.S. Cl.
CPC ..... *H01B 7/185* (2013.01)

(58) Field of Classification Search
USPC ..... 174/107, 113 R, 124 R
See application file for complete search history.

(56) References Cited

U.S. PATENT DOCUMENTS 4,707,569 A * 11/1987 Yoshimura et al. ..... 174/116
5,061,823 A * 10/1991 Carroll ..... 174/105 R
6,233,384 B1 * 5/2001 Sowell et al. ..... 385/107
6,504,379 B1 * 1/2003 Jackson ..... 324/539
6,525,271 B2 * 2/2003 Groegl et al. ..... 174/105 R
7,141,740 B2 * 11/2006 Ko ..... 174/128.1
7,164,078 B2 * 1/2007 Grogl et al. ..... 174/36
2003/0056969 A1 * 3/2003 Eves et al. ..... 174/68.1
2004/0055780 A1 * 3/2004 Hakkarainen et al. .... 174/120 R
2010/0107860 A1 * 5/2010 Dobesberger et al. ..... 89/36.02
2011/0126508 A1 * 6/2011 Rice ..... 60/39.091

* cited by examiner

*Primary Examiner* — Chau N Nguyen
(74) *Attorney, Agent, or Firm* — Merchant & Gould P.C.

(57) ABSTRACT

A rugged cable may be provided. The rugged cable may comprise a first layer, a second layer, and a third layer. The first layer may comprise fibers in which chain molecules comprising the fibers of the first layer are highly oriented along axis of the fibers of the first layer. The second layer may be around the first layer. The second layer may comprise metal. The third layer may be around the second layer. The third layer may comprise fibers in which chain molecules comprising the fibers of the third layer are highly oriented along axis of the fibers of the third layer.

15 Claims, 2 Drawing Sheets

RUGGED CABLE

COPYRIGHTS

All rights, including copyrights, in the material included herein are vested in and the property of the Applicants. The Applicants retain and reserve all rights in the material included herein, and grant permission to reproduce the material only in connection with reproduction of the granted patent and for no other purpose.

BACKGROUND

Power cords are too often cut, crushed, or damaged due to impact in the field. Consequently, there is a need for a power cable with increased integrity under abusive conditions while maintaining safety of use.

SUMMARY

This Summary is provided to introduce a selection of concepts in a simplified form that are further described below in the Detailed Description. This Summary is not intended to identify key features or essential features of the claimed subject matter. Nor is this Summary intended to be used to limit the claimed subject matter's scope.

A rugged cable may be provided. The rugged cable may comprise a first layer, a second layer, and a third layer. The first layer may comprise fibers in which chain molecules comprising the fibers of the first layer are highly oriented along axis of the fibers of the first layer. The second layer may be around the first layer. The second layer may comprise metal. The third layer may be around the second layer. The third layer may comprise fibers in which chain molecules comprising the fibers of the third layer are highly oriented along axis of the fibers of the third layer.

Both the foregoing general description and the following detailed description provide examples and are explanatory only. Accordingly, the foregoing general description and the following detailed description should not be considered to be restrictive. Further, features or variations may be provided in addition to those set forth herein. For example, embodiments may be directed to various feature combinations and subcombinations described in the detailed description.

BRIEF DESCRIPTION OF THE DRAWINGS

The accompanying drawings, which are incorporated in and constitute a part of this disclosure, illustrate various embodiments of the present invention. In the drawings.

DETAILED DESCRIPTION

Figure 1A:
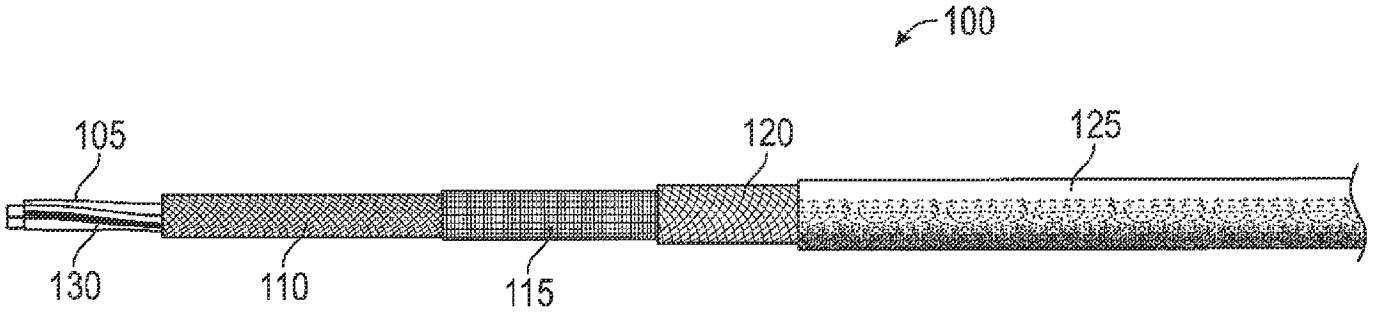
FIG. 1A shows a side view of a rugged cable.

The following detailed description refers to the accompanying drawings. Wherever possible, the same reference numbers are used in the drawings and the following description to refer to the same or similar elements. While embodiments of the invention may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the invention.

Consistent with embodiments of the invention, a rugged cable may be provided. The rugged cable consistent with embodiments of the invention may be extremely flexible and may provide an improved crush, cut, and impact resistance over conventional cables. Consequently, embodiments of the invention may provide a rugged cable with increased integrity under abusive conditions.

Figure 1B:
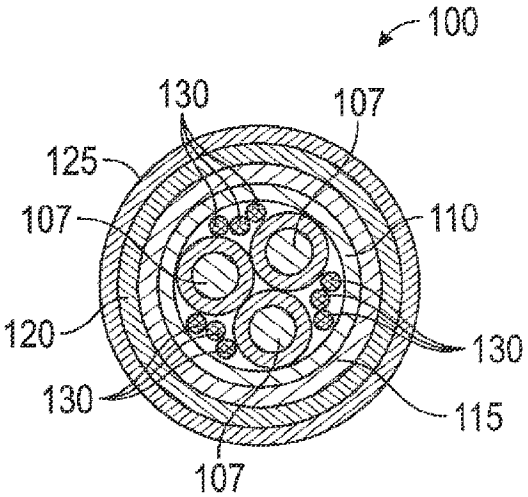
FIG. 1B shows a cross-sectional view of a rugged cable.

FIG. 1A and FIG. 1B show a rugged cable 100. As shown FIG. 1A and FIG. 1B, rugged cable 100 may comprise a cable core 105, a first layer 110, a second layer 115, a third layer 120, and a jacket 125. Cable core 105 may comprise a plurality of conductors 107. While FIG. 1B shows cable core 105 as having three conductors 107, consistent with embodiments of the invention, cable core 105 may comprise any number of conductors 107 and is not limited to three. Also, while FIG. 1A and FIG. 1B show rugged cable 100 as having three layers, embodiments of the invention may include any number of layers and are not limited to three layers.

Each of conductors 107 may be insulated with, for example, a cross linked polyethylene, polyvinyl chloride or any type of thermo set or thermo plastic material configured to provide electrical insulation. Also, each of conductors 107 may comprise, but are not limited to, copper, copper alloy, aluminum, or aluminum alloy, and may be stranded or solid. Stranded conductors, however, may provide rugged cable 100 with more overall flexibility. Furthermore, a filler material 130 may be provided in some or all of the space between cable core 105 and first layer 110. Filler material 130 may comprise fiber strands generally oriented along a long axis of rugged cable 100. Filler material 130 may help to keep rugged cable 100 in a substantially round shape during rugged cable 100's use and operation.

First layer 110 may comprise braided fibers configured to fit snuggly around cable core 105. Fibers may be configured in numerous variations by type of material and, for example, in three dimensional or two dimensional variants. The fibers comprising first layer 110 may comprise heat-resistant, strong synthetic fibers. For example, the fibers comprising first layer 110 may comprise fibers in which chain molecules comprising the fibers are highly oriented along the fiber's axis, so the strength of chemical bonds in the fibers can be exploited. The fibers may comprise, for example, para-aramid synthetic fibers (e.g. Kevlar®, Twaron®, etc.).

Second layer 115 may comprise braided stainless steel wires configured to fit snuggly around first layer 110. Second layer 115 may be braided in a manner similar to first layer 110. Braiding configurations may include, but not be limited to, two dimensional or three dimensional variants for example. The stainless steel wires comprising second layer 115 may comprise, but are not limited to, Society of Automotive Engineers (SAE) grade 304 stainless steel. Consistent with embodiments of the invention, second layer 115 may comprise a chain mail material comprising small metal rings linked together in a pattern to form a mesh.

Third layer 120 may comprise braided fibers configured to fit snuggly around second layer 115. Fibers may be configured, for example, in numerous variations by type of material and in three dimensional or two dimensional variants. The fibers comprising third layer 120 may comprise the same material as first layer 110 and may be braided in a manner similar to first layer 110 and second layer 115.

Jacket 125 may be configured to fit snuggly around third layer 120. Jacket 125 may comprise an oil resistant and/or ultraviolet resistant thermo plastic or thermo set material. Furthermore, jacket 125 may be resistant to scoring.

In operation of rugged cable 100, a foreign element my cut into rugged cable 100. Consistent with embodiments of the invention, third layer 120 may be configured to bind and therefore may slow down the foreign element that my cut through jacket 125. After third layer 120 binds or at least slows down the foreign element that my cut through jacket 125, second layer 115 may cause the foreign element to stop before the foreign element shorts any of conductors 107 in conductor core 105 to ground. However, if enough mechanical energy is present and foreign element is not stopped by second layer 115, first layer 110 may further slow down the foreign element and may cause the foreign element to stop before the foreign element shorts any of conductors 107 in conductor core 105 to ground. Consequently, embodiments of the invention may provide rugged cable 100 with high integrity under abusive conditions while maintaining safety of rugged cable 100's use.

Figure 2:
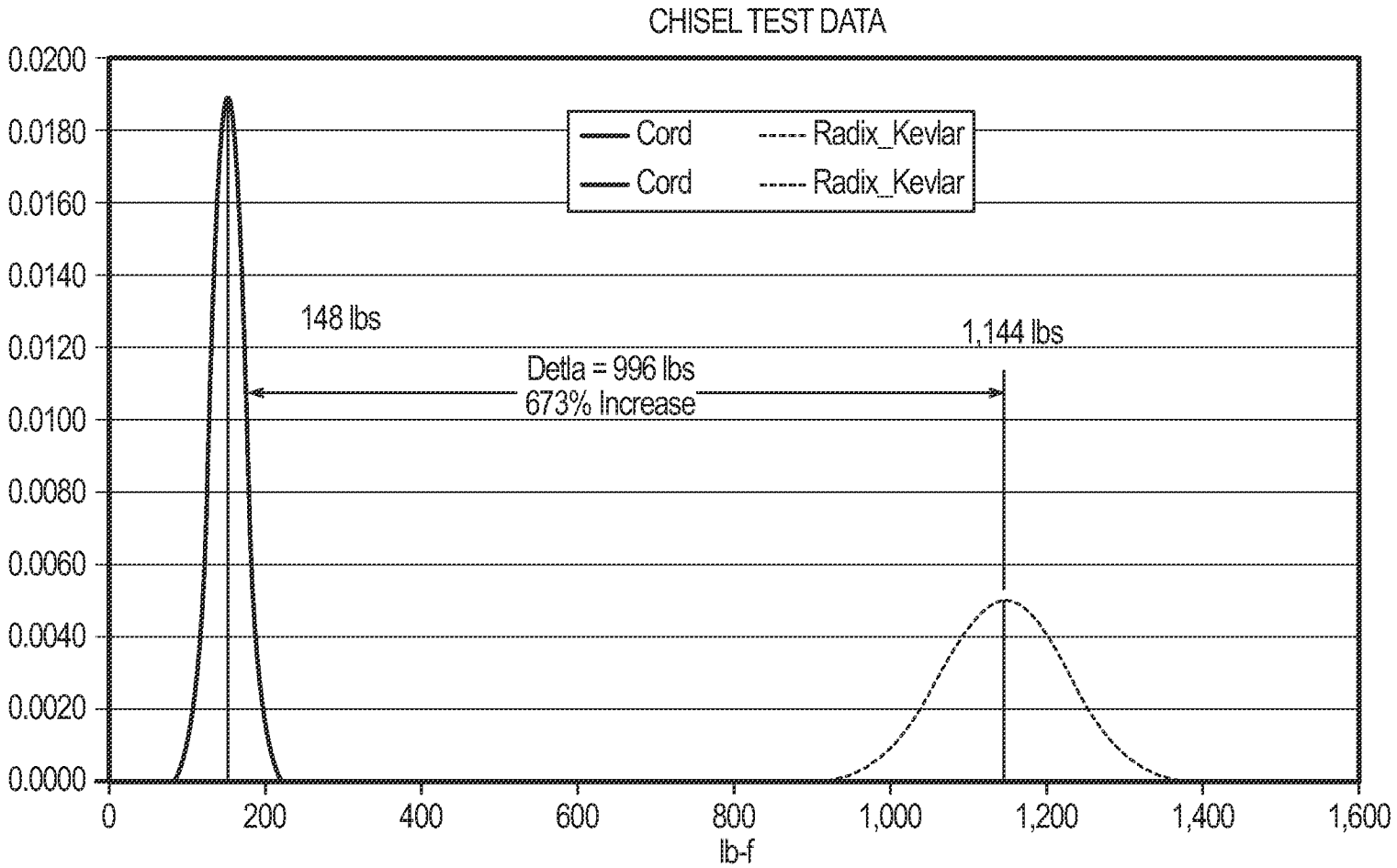
FIG. 2 shows performance characteristics.

FIG. 2 is a graph showing improved performance characteristics consistent with embodiments of the invention over conventional power cords. As shown in FIG. 2, embodiments of the invention may provide, for example, a 673% improvement based on chisel test data shown in FIG. 2

While certain embodiments of the invention have been described, other embodiments may exist. Further, the disclosed methods' stages may be modified in any manner, including by reordering stages and/or inserting or deleting stages, without departing from the invention. While the specification includes examples, the invention's scope is indicated by the following claims. Furthermore, while the specification has been described in language specific to structural features and/or methodological acts, the claims are not limited to the features or acts described above. Rather, the specific features and acts described above are disclosed as example for embodiments of the invention.

What is claimed is:

1. A rugged cable comprising:

a flexible cable core comprising at least one insulated conductor consisting of metal;

a flexible first layer around the flexible cable core, the flexible first layer comprising braided para-aramid synthetic fibers;

a flexible filler disposed around the flexible cable core, the flexible filler filling at least a portion of a space between the flexible first layer and the flexible cable core, the flexible filler comprising fiber strands generally oriented along a long axis of the rugged cable;

a flexible second layer around the flexible first layer, the flexible second layer consisting of braided stainless steel wires comprising Society of Automotive Engineers (SAE) grade 304 stainless steel;

a flexible third layer around the flexible second layer, the flexible third layer comprising braided para-aramid synthetic fibers wherein the para-aramid synthetic fibers of the flexible first layer, the stainless steel wires of the flexible second layer, and the para-aramid synthetic fibers of the flexible third layer are all braided in a similar fashion, the flexible third layer configured to bind and retard foreign elements; and a flexible jacket around the flexible third layer.

2. The rugged cable of claim 1, wherein the flexible filler is configured to keep the rugged cable in a substantially round shape during use.

3. The rugged cable of claim 1, wherein the rugged cable exhibits an increase in chisel test performance ranging from about 200% to about 600%.

4. The rugged cable of claim 1, wherein the flexible jacket comprises at least one of the following: an oil resistant material, an ultraviolet light resistant material, a thermo plastic material, and a thermo set material.

5. The rugged cable of claim 1, wherein the flexible first layer is disposed around the flexible cable core.

6. The rugged cable of claim 1, wherein the flexible cable core comprises a plurality of conductors being one of the following: stranded and solid.

7. The rugged cable of claim 1, wherein the flexible cable core comprises a plurality of conductors comprising one of the following: aluminum and copper.

8. A rugged cable comprising:

a flexible cable core comprising at least one insulated conductor consisting of metal;

a flexible first layer around the flexible cable core, the flexible first layer comprising braided para-aramid synthetic fibers;

a flexible filler disposed around the flexible cable core, the flexible filler filling at least a portion of a space between the flexible first layer and the flexible cable core, the flexible filler comprising fiber strands generally oriented along a long axis of the rugged cable;

a flexible second layer around the flexible first layer, the flexible second layer consisting of braided stainless steel wires comprising Society of Automotive Engineers (SAE) grade 304 stainless steel; and a flexible third layer around the flexible second layer, the flexible third layer comprising braided para-aramid synthetic fibers wherein the para-aramid synthetic fibers of the flexible first layer, the stainless steel wires of the flexible second layer, and the para-aramid synthetic fibers of the flexible third layer are all braided in a similar fashion, the flexible third layer configured to bind and retard foreign elements.

9. The rugged cable of claim 8, wherein the flexible filler is configured to keep the rugged cable in a substantially round shape during use.

10. The rugged cable of claim 8, wherein the rugged cable exhibits an increase in chisel test performance ranging from about 200% to about 600%.

11. The rugged cable of claim 8, further comprising a flexible jacket around the flexible third layer.

12. The rugged cable of claim 11, wherein the flexible jacket comprises at least one of the following: an oil resistant material, an ultraviolet light resistant material, a thermo plastic material, and a thermo set material.

13. The rugged cable of claim 8, wherein the flexible first layer is disposed around the flexible cable core.

14. The rugged cable of claim 8, wherein the flexible cable core comprises a plurality of conductors being one of the following: stranded and solid.

15. The rugged cable of claim 8, wherein the flexible cable core comprises a plurality of conductors comprising one of the following: aluminum and copper.

* * * * *